United States Patent [19]

Drixler

[11] 4,294,148

[45] Oct. 13, 1981

[54] GUARDS FOR CIRCULAR SAW BLADES OF CIRCULAR SAWING MACHINES

[75] Inventor: Karl Drixler, Nürtingen-Neckarhausen, Fed. Rep. of Germany

[73] Assignee: Chr. Eisele Maschinenfabrik GmbH. & Co. KG, Fed. Rep. of Germany

[21] Appl. No.: 102,122

[22] Filed: Dec. 10, 1979

[30] Foreign Application Priority Data

Dec. 16, 1978 [DE] Fed. Rep. of Germany ... 7837368[U]

[51] Int. Cl.[3] ..... B27B 5/29

[52] U.S. Cl. ..... 83/397; 83/478

[58] Field of Search ..... 83/397, 478, 544–546; 74/612, 615

[56] References Cited

U.S. PATENT DOCUMENTS 2,413,016 12/1946 Wiken et al. ..... 83/478 X

*Primary Examiner*—J. M. Meister

*Attorney, Agent, or Firm*—Olsen and Stephenson

[57] ABSTRACT

A guard for the circular saw blade of a circular sawing machine whose sawing unit has a horizontally supported saw spindle and is disposed on a frame of the machine so as to be vertically movable, the guard being arranged to cover the circular saw blade from above and at least partially on an accessible end face thereof and on the circumferential portion on an operating side, the guard forming a housing arranged to be mounted on the machine frame so as to be fixed relative to the circular saw blade and being open at its bottom only and, in its starting position, completely accommodating the circular saw blade, a downwardly extending elongate opening being disposed in a side wall of the housing to accommodate the saw spindle and being associated with a covering element arranged to move between a covering position, in which the covering element covers at least one region having disposed therein the circumference of the circular saw blade and being associated with the part of the elongate opening disposed beneath the saw spindle when the circular saw blade is in an upper starting position, and a released position, the covering element progressively exposing the said part of the elongate opening when feed motion of the circular saw blade is performed.

9 Claims, 6 Drawing Figures

GUARDS FOR CIRCULAR SAW BLADES OF CIRCULAR SAWING MACHINES

The invention relates to guards for the circular saw blades of circular sawing machines of the type having a vertically movable sawing unit, which has a horizontally supported saw spindle and is disposed on a frame of the machine, and being arranged to cover the circular saw blade from above and at least partially on an accessible end face thereof and on the circumferential portion on an operating side.

Different embodiments of guards of this kind are known. These constructions comprise a narrow guard, to be mounted on the frame unit and arranged to grip over the circular saw blade from above to accommodate approximately half of the saw blade within the guard.

A lateral cover, formed by a plate element and extending over the circumferential part of the circular saw blade on the operating side, is associated with the said guard for the purpose of screening the end face of the second half of the circular saw blade opposite to the sawing unit over a circumferential portion on the operating side. The covering comprises transparent plastics to provide good visibility in the operating range of the said circular saw blade.

Furthermore, the covering is arranged to be vertically adjustable and lockable relative to the guard so that when the circular sawing machine is set up, the said covering can be adjusted so that its bottom edge is disposed directly above the workpiece which is to be sawn through.

By means of this covering, the known guard therefore provides effective protection against touching on the free accessible end face of the circular saw blade as well as on the operating side.

However, the portion of the circular saw blade which projects downwardly on the side of the sawing unit is freely accessible and for this reason this construction no longer meets the requirements of testing principles for metal machining and processing machines, which principles specify inter alia that reaching into the cutting portion must be prevented when the circular saw blade is stationary or that only the part of the saw blade used for cutting shall be exposed in the operating position.

According to the invention, there is provided a guard for the circular saw blade of a circular sawing machine whose sawing unit has a horizontally supported saw spindle and is disposed on a frame of the machine so as to be vertically movable, the guard being arranged to cover the circular saw blade from above and at least partially on an accessible end face thereof and on the circumferential portion on an operating side, the guard forming a housing arranged to be mounted on the machine frame so as to be fixed relative to the circular saw blade and being open at its bottom only and, in its starting position, completely accommodating the circular saw blade, a downwardly extending elongate opening being disposed in a side wall of the housing to accommodate the saw spindle and being associated with a covering element arranged to move between a covering position, in which the covering element covers at least one region having disposed therein the circumference of the circular saw blade and being associated with the part of the elongate opening disposed beneath the saw spindle when the circular saw blade is in an upper starting position, and a released position, the covering element progressively exposing the said part of the elongate opening when feed motion of the circular saw blade is performed.

Preferably the elongate opening, which accommodates the saw spindle, extends in the housing side wall to the bottom edge thereof. Accordingly, given a suitable design of the housing it is possible for circular saw blades of relatively large and relatively small diameter to be used on circular sawing machines and, in the case of a relatively small circular saw blade, the saw spindle is able to emerge downwardly from the housing.

For example, the covering element, which covers the elongate opening for receiving the saw spindle in the starting position thereof, can be arranged to slide and can be made appropriately adjustable for exposing or covering the elongate housing opening by means of an adjusting device operating in synchronism with the vertical motion of the saw spindle. However, preferably the covering element is pivotable between its covering and exposing positions about an axis which is parallel with the saw spindle.

Preferably, the covering element is constructed as a one-armed pivoting lever whose pivoting axis is positioned above the saw spindle so that the covering element is pivotable automatically into its covering position.

Preferably, the saw spindle forms an actuating element for deflecting the covering element from its covering position to its released position when the saw spindle is moved in the feed direction. Thus, the required pivoting motions of the covering element for covering and exposing the saw spindle opening can be obtained without an additional adjusting device.

Preferably the covering element is disposed on the outside of the housing side wall which incorporates the elongate opening for the saw spindle.

Preferably, the housing is provided with a closable wall opening to facilitate exchanging of the circular saw blade.

To ensure that the bottom boundary edge of the housing is always set into a position directly above the workpieces which are to be cut through to ensure that there is no lateral access to the circular saw blade from the operating position, preferably the housing is disposed on the machine frame so as to be vertically steplessly adjustable and lockable.

The guard may be provided with a spraying device so that the circular saw blade can be wetted in a completely surrounded zone with coolant and lubricating fluid, with the said fluids emerging only downwardly from the housing so that they cannot splash.

The invention will be further described, by way of example, with reference to the accompanying drawings, in which.

Figure 1:
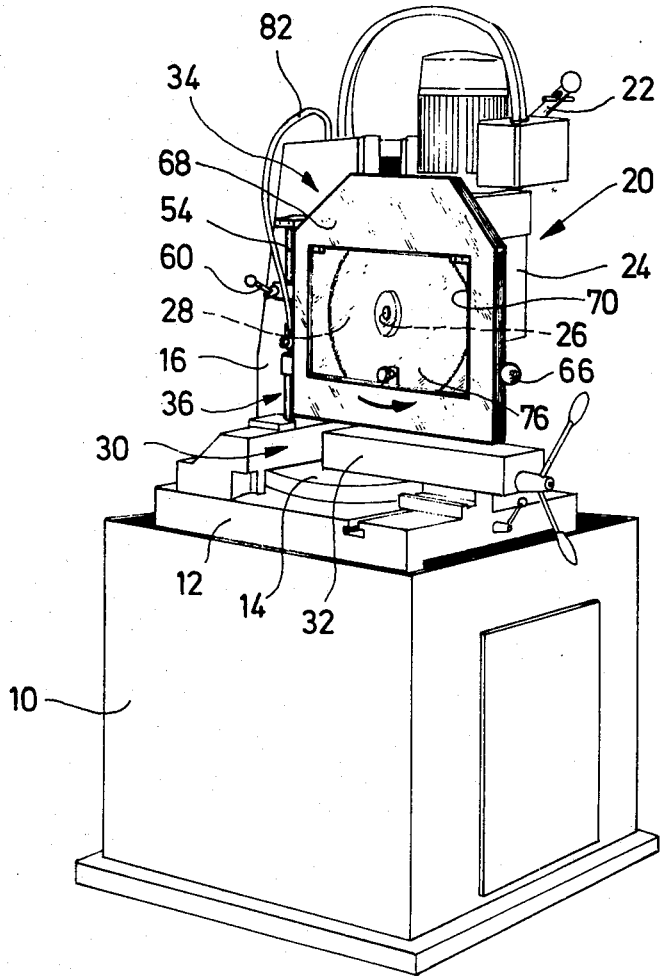
FIG. 1 is a general view of a sawing machine with a vertically adjustable sawing unit in perspective and having attached thereto a guard constituting a preferred embodiment of the invention.

FIG. 1 shows a known circular cold sawing machine for performing parallel cuts, longitudinal cuts and mitre cuts. It is provided with box-shaped base 10, the top of which has a table superstructure 12 which forms the base of the machine frame associated with the circular sawing machine. The numeral 14 refers to a pivoting plate, having mounted thereon a machine frame 16 and being supported in the middle of the table superstructure 12 so as to be rotatable and lockable. A sawing unit, referenced in its entirety by the numeral 20, is disposed on the frame 16 so as to be vertically slidable and to be adjustable in both directions by means of a hand lever 22.

The sawing unit is provided with a saw spindle 26, horizontally supported in a transmission casing 24 of the sawing unit, and a circular saw blade 28 is mounted on the saw spindle. The numeral 30 refers to the totality of a workpiece clamping device by means of whose manually adjustable vice jaw 32 metal sections for cutting can be clamped on the pivoting plate 14.

The components of the workpiece clamping device 30 are disposed on the table superstructure 12 so that the pivoting plate 14 can be rotated relative to the device for adjustment of the circular saw blade 28 to enable parallel, longitudinal or mitre cuts to be performed.

At least one pumping unit is installed in the base 10, by means of which pumping unit it is possible for pressure medium to be supplied for performing an automatic working feed motion and/or for coolant and/or lubricant fluid to be supplied to the circular saw blade.

As shown in FIG. 1, the circular saw blade 28 is disposed in complete encapsulation within a relatively narrow, box-like housing 34 with a guard device for the circular saw blade. The housing is retained, separately of the saw unit 20, on the machine frame 16 by means of a mounting device referenced in its entirety by the numeral 36.

With the exception of its open bottom longitudinal edge, the housing is completely enclosed.

The construction of the housing 34 will described with reference to FIGS. 2 to 6.

Figure 5:
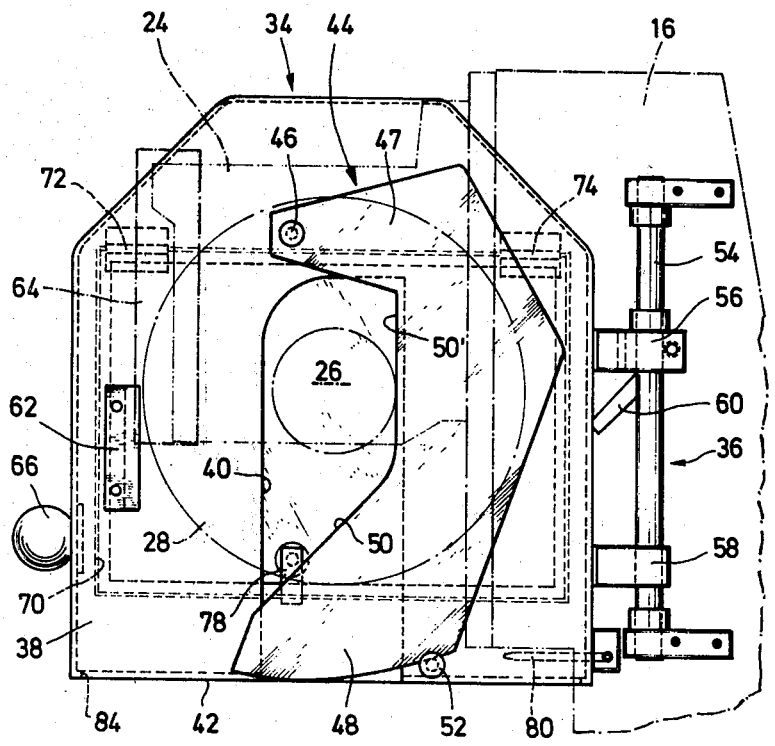
FIG. 5 is a rear view of the guard corresponding to FIG. 2.
Figure 6:
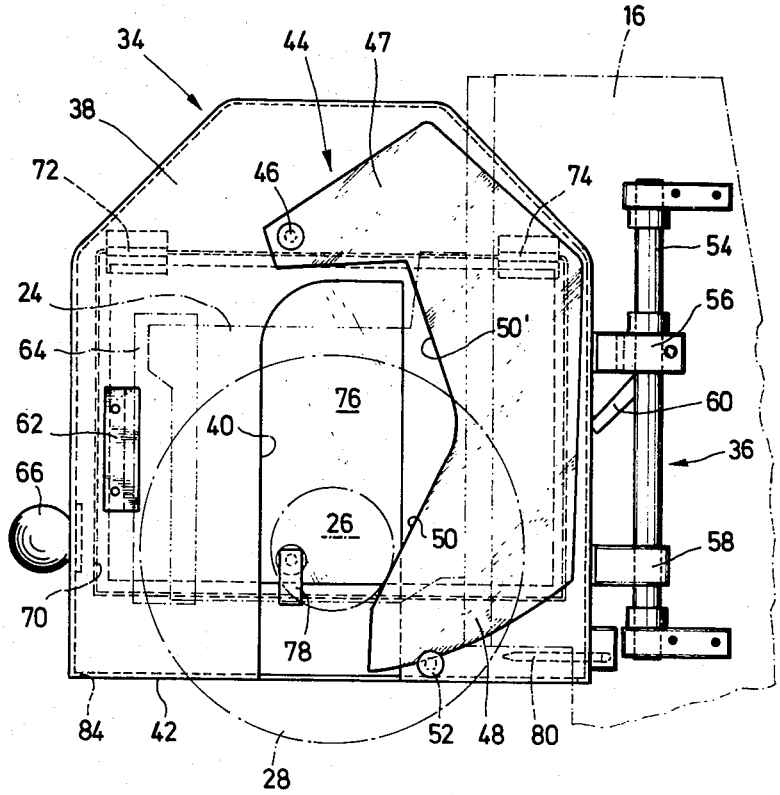
FIG. 6 is a rear view of the guard corresponding to FIG. 4.

As shown in FIGS. 5 and 6, the housing side walls 38 adjacent to the sawing unit 20 are provided with an elongate slot-like opening 40 which extends in the middle part of the housing side wall, starting from the top half thereof, in the downward direction and is accessible from the bottom housing edge 42. The saw spindle 26 extends through the opening 40 into the interior of the housing and can move along the said opening 40 when a working stroke is performed or when the sawing unit is retracted to its top starting position.

A covering element, constructed as a one-armed pivoting lever and referenced in its entirety by the numeral 44, is disposed on the housing side wall 38. The pivoting axis of the said pivoting lever is designated with the numeral 46 and is provided above the elongate opening 40. The shape of the covering element, formed by a correspondingly shaped plate, the position of the pivoting axis 46 and the position of the centre of gravity of the plate or of the cutting elements are arranged so that the covering element, disposed in a vertical plane, moves under the action of gravitational force automatically into a covering position illustrated in FIG. 5 in which position it covers at least the bottom region of the elongate opening 40. This is conditional upon the saw spindle 26 being in its top starting position in the housing as illustrated in FIG. 5 so that the end member 48 of the covering element, which can pivot freely and covers the opening 40, is able to pivot into its covering position according to FIG. 5. In the present embodiment, the shape of the covering element is comparable to that of a boomerang, one end member 47 of which is supported by the pivoting shaft 46, which is fixed to the housing, the internal edge of the other end member 48 forming a rectilinear ramp 50 which extends at an angle to the plane of motion of the saw spindle. The numeral 52 refers to a guide element, fixed to the housing and arranged to guide the free end member 48 of the covering element in the course of its pivoting motion.

If the sawing unit 20 is moved downwardly, for example by means of the hand lever 22, for performing a sawing feed motion, and is therefore adjusted relative to the housing 34, the saw spindle 26 will be displaced downwardly in the elongate opening 40 of the housing side wall 38. So long as the said saw spindle moves along an adjacent rectilinear partial edge member 50' of the covering element 44, which extends parallel with the plane of the motion, the said covering element will retain its covering position shown in FIG. 5 so that the circular saw blade 28, more particularly the circumferential region thereof, remains covered to provide effective protection against touching of its saw teeth. From a specific feed position onwards, the saw spindle will then move upon theramp 60 so that the covering element is pivoted in the anticlockwise direction, according to FIG. 6, and a path is thus exposed for the continuous downward motion of the saw spindle 26. If the sawing unit returns to its starting position after reaching the final feed position, the covering element 44 will automatically return into its covering position, as already explained previously.

Figure 3:
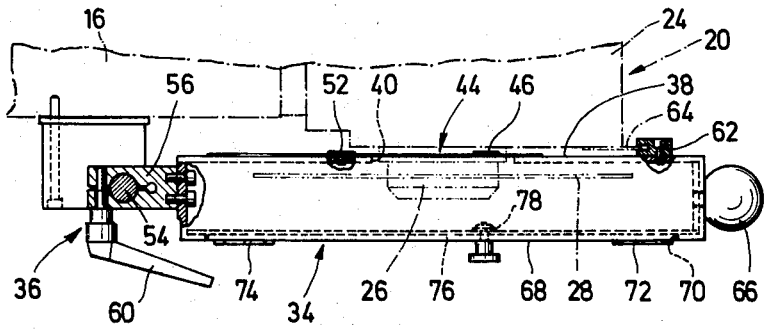
FIG. 3 is a plan view of the guard of FIG. 1 in part-section.
Figure 4:
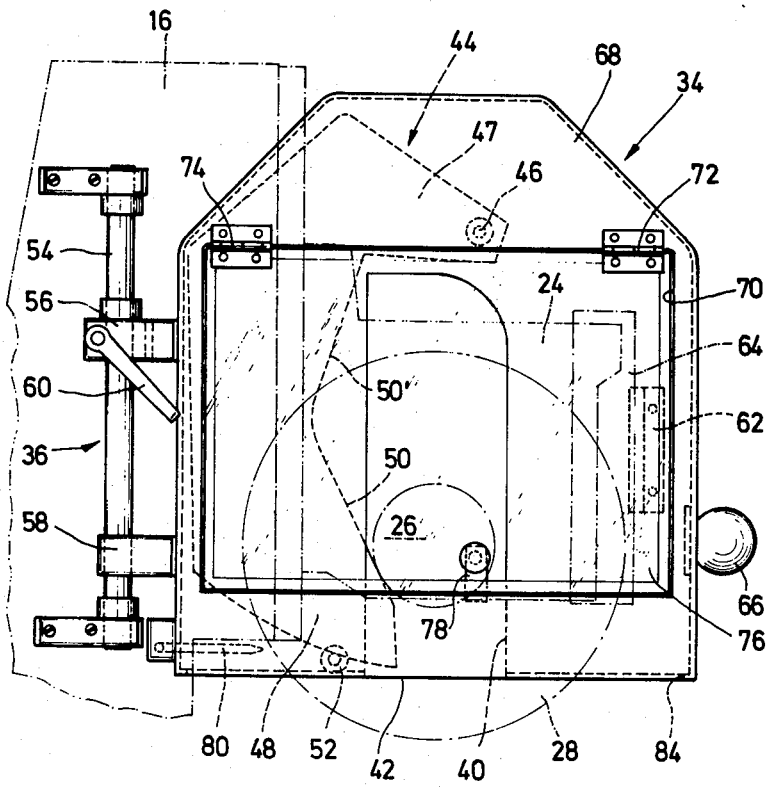
FIG. 4 is a view of the guard similar to that of FIG. 2 but with the circular saw blade of the machine indicated in its bottom limiting position.

FIG. 3 shows the housing 34 disposed at a short parallel distance from the sawing unit 20 and accordingly the covering element 44, hinged to the outside of the housing side wall 38, is pivotably movable between the housing and the sawing unit.

The mounting device 36 for mounting the housing 34 is provided with a vertical retaining rod 54, disposed laterally on the machine frame 16, on which retaining rod the housing is arranged so as to be axially adjustable and lockable by means of two guide and retaining members 56, 58. The top retaining member 56 forms a claw which can be clamped, for example by means of a toggle lever 60. To stabilize the housing 34 in a plane which is substantially parallel with the sawing unit, the guide member 62, having a longitudinal groove which engages with a guide plate 64 mounted on the sawing unit, is fixed to the housing side wall 38. The numeral 66 refers to a handle, more particularly a ball-shaped handle, which is provided on the front narrow longitudinal housing wall in the bottom region thereof and functions as handle for the purpose of steplessly variable adjustment of the housing when the claw 56 is released.

A wall opening 70, more particularly or rectangular shape, is situated in the front housing side wall 68 and can be closed by a flap 76, retained by hinges 72, 74 and can be locked in its closed position by means of a locking element 78. The said flap provides access to the free end of the saw spindle for the purpose of mounting and removing circular saw blades.

The numeral 80 refers to a spraying device arranged in a stationary position within the housing in the bottom region thereof to supply coolant and/or lubricant fluid by means of a supply hose 82 so that one or both sides of the saw blade can be sprayed.

Figure 2:
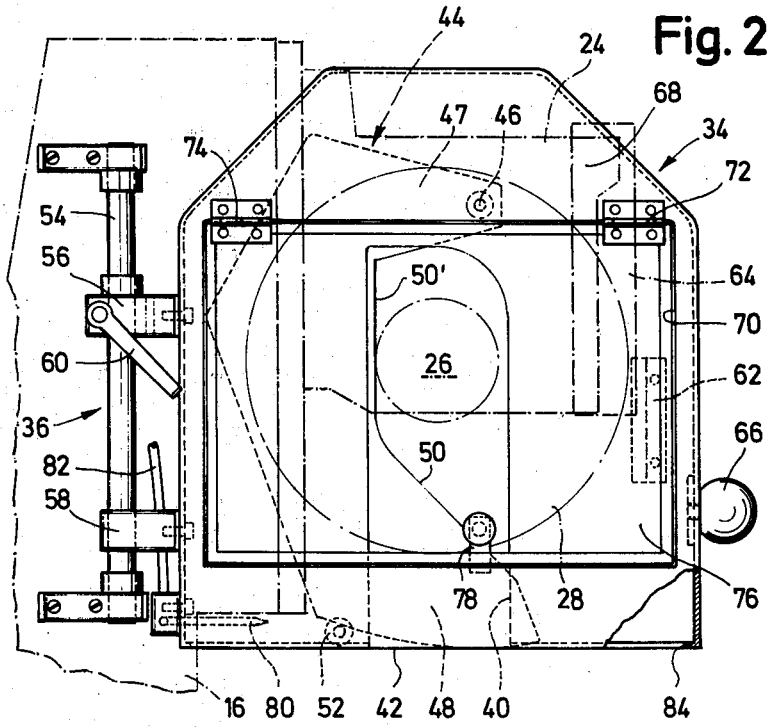
FIG. 2 is a front view of the guard of FIG. 1.

Like the circular saw blade, the fluid can emerge from the bottom housing opening 84 (FIG. 2). As shown in FIG. 1, it is advantageous to position the housing 34 relative to the guard in such a way that the bottom housing edge 42 always bears either on the clamping device 30 or on a metal section which is to be cut through or is situated at a very short distance above these parts.

The covering element 44 is constructed so that, as shown in FIG. 6, it exposes the elongate opening 40 in the rear casing wall 38 to a substantial extent only after the circular saw blade has already plunged into the appropriate workpiece to ensure that, in every phase of motion of the circular saw blade in the feed direction, the circumferential region of the said saw blade or the saw teeth thereof are covered when they do not penetrate into the workpiece.

I claim:

1. A guard for the circular saw blade of a circular sawing machine whose sawing unit has a horizontally supported saw spindle and is disposed on a frame of the machine so as to be vertically movable, the guard being arranged to cover the circular saw blade from above and at least partially on an accessible end face thereof and on the circumferential portion of an operating side, the guard forming a housing arranged to be mounted on the machine frame so as to be fixed relative to the circular saw blade with the latter in an upper starting position, said housing being open at its bottom only and, with said saw blade in its upper starting position, said housing completely accommodating the circular saw blade, a downwardly extended elongate opening being disposed in a side wall of the housing to accommodate the saw spindle and being associated with a covering element arranged to move between a covering position, in which the covering element covers at least one region having disposed therein the circumference of the circular saw blade and being associated with the part of the elongate opening disposed beneath the saw spindle when the circular saw blade is in the upper starting position, and a released position, the covering element operating toward said released position and progressively exposing the said part of the elongate opening when feed motion of the circular saw blade is performed, the saw spindle traveling within the elongate opening during such feed motion.

2. A guard as claimed in claim 1, in which the elongate opening, which accommodates the saw spindle, extends in the housing side wall to the bottom edge thereof.

3. A guard as claimed in claim 1 or 2, in which the covering element is pivotable between its covering and exposing positions about an axis which is parallel with the saw spindle.

4. A guard as claimed in claim 3, in which the covering element is constructed as an one-armed pivoting lever whose pivoting axis is positioned above the saw spindle so that the covering element is pivotable automatically into its covering position.

5. A guard as claimed in claim 1, in which the saw spindle forms an acutating element for deflecting the covering element from its covering position to its released position when the saw spindle is moved in the feed direction.

6. A guard as claimed in claim 1, in which the covering element is disposed on the outside of the housing side wall which incorporates the elongate opening for the saw spindle.

7. A guard as claimed in claim 1, in which a wall opening which is closable by means of a transparent flap is provided in the freely accessible housing side wall for the purpose of exchanging the circular saw blade.

8. A guard as claimed in claim 1, in which the housing is arranged to be disposed on the machine frame so as to be vertically steplessly adjustable and lockable.

9. A guard as claimed in claim 1, in which a spraying device for spraying the circular saw blade with coolants and/or lubricating fluids is disposed within the housing.

* * * * *